US005190461A

United States Patent [19]

Oorui et al.

[11] Patent Number: 5,190,461

[45] Date of Patent: Mar. 2, 1993

[54] CONNECTOR ASSEMBLY WITH BOTH FUNCTIONS OF COAXIAL CONNECTOR AND MULTIPLE CONTACT CONNECTOR

[75] Inventors: Kazuya Oorui; Hisamitsu Takagi, both of Kawasaki, Japan

[73] Assignee: Fujitsu Limited, Kawasaki, Japan

[21] Appl. No.: 898,336

[22] Filed: Jun. 15, 1992

[30] Foreign Application Priority Data

Jun. 17, 1991 [JP] Japan ..... 3-144575

[51] Int. Cl.[5] ..... H01R 9/09

[52] U.S. Cl. ..... 439/63; 439/74

[58] Field of Search ..... 439/62, 63, 64, 65, 439/74, 75, 79, 581, 582, 629, 632

[56] References Cited

U.S. PATENT DOCUMENTS 4,352,533 10/1982 Murase et al. ..... 439/74
4,806,107 2/1989 Arnold et al. ..... 439/608
4,907,977 3/1990 Porter ..... 439/74
4,996,478 2/1991 Pope ..... 439/581
5,114,353 5/1992 Sample ..... 439/74

*Primary Examiner*—Larry I. Schwartz
*Assistant Examiner*—Hien D. Vu
*Attorney, Agent, or Firm*—Armstrong, Westerman, Hattori, McLeland & Naughton

[57] ABSTRACT

A connector assembly functioning simultaneously as a coaxial connector and a multiple contact connector, which is interposed between a first and a second printed wiring boards extending in parallel with each other for the connection of electronic circuits formed on the first and second printed wiring boards with external circuits. A coaxial connector including a housing with an opening is secured to one end of the first printed wiring board, while a multiple connector having a configuration to be received through the opening is fixed to one end of the second printed wiring board. When the first and the second printed wiring boards are held in parallel with each other, the multiple connector is allowed to be positioned within the housing by way of the opening of the coaxial connector housing.

4 Claims, 5 Drawing Sheets

CONNECTOR ASSEMBLY WITH BOTH FUNCTIONS OF COAXIAL CONNECTOR AND MULTIPLE CONTACT CONNECTOR

BACKGROUND OF THE INVENTION

1. Field of the Invention

The present invention relates to a connector assembly having both functions of a coaxial connector and a multiple contact connector, and more particularly, is directed to a coaxial multiple composite connector applicable to a small-sized electronic equipment such as a portable telephone set.

2. Description of the Related Art

Small-sized electronic equipment such as a portable telephone set possibly employ a structure in which a printed wiring board having an electronic circuit provided thereon is divided into two or more sections, and the obtained subsidiary printed wiring boards are disposed in parallel with one another so as to effectively utilize a space defined within a casing thereof. On the other hand, a connector may be used to connect such electronic equipment with external circuits, and hence the structure of the connector having a superior loading properties is strongly desired.

In order to connect a high-frequency circuit such as a transmit and receive circuit provided on a printed wiring board with the external circuits, hitherto, a coaxial connector has been generally used. Such coaxial connector may be used, for example, in the case of providing an external antenna to improve the sensitivity of the portable telephone set. On the other hand, a multiple connector fitted with a plurality of contacts may be used for the connection of a low-frequency circuit such as a logic circuit formed on the printed wiring board, or a power supply circuit, with the external circuits. Such multiple connector may be used, for example, when connecting the portable telephone set with a hand-free unit, a measurement equipment or the like.

Up to now, at the necessity for the coaxial connector and the multiple connector, they must be independently fixed to the printed wiring board. This leads disadvantageously to a poor manipulability for the use of the connectors.

In order to overcome the above problem, there has been proposed a composite connector consisting of merely integrated coaxial connector and multiple connector, which involves a problem that when mounting on the surface of the printed wiring board, its cleaning properties are extremely deteriorated due to cleaning fluid remaining within the connector. Additionally, for the use of such composite connector together with a plurality of printed wiring boards, a further additional connector must be provided for the connection between the two printed wiring boards since the composite connector permits only a connection of a single printed wiring board, which prevents a reduction in size of the device.

SUMMARY OF THE INVENTION

It is therefore an object of the present invention to provide a connector assembly having both functions of the coaxial connector and the multiple contact connector, and presenting a simple construction and a superior manipulability as a connector.

In accordance with an aspect of the present invention, there is provided a connector assembly having both functions of a coaxial connector and a multiple connector, comprising: a first printed wiring board having conductive patterns provided thereon; a coaxial connector secured to one end of said first printed wiring board, said coaxial connector including a housing having an opening with a predetermined configuration, and a plurality of terminals connected by means of solder to said conductive patterns of said first printed wiring board; a second printed wiring board having conductive patterns provided thereon; a multiple connector having a plurality of contacts fixed to one end of said second printed wiring board and having a configuration to be received through said opening of said coaxial connector; said plurality of contacts of said multiple connector being connected by means of solder to said conductive patterns of said second printed wiring board; and means for supporting said first printed wiring board and said second printed wiring board in a parallel relationship with each other in such a manner that said multiple connector is positioned within said housing through said opening of said housing of said coaxial connector.

Preferably, said means for supporting said first and second printed wiring boards in a parallel relationship with each other includes said housing of said coaxial connector, and a spacer member interposed between the other ends of said first and second printed wiring boards.

In accordance with another aspect of the present invention, there is provided a connector assembly having both functions of a coaxial connector and a multiple connector, comprising: a first printed wiring board having conductive patterns provided thereon; a connector housing fixed on one end of said first printed wiring board, said connector housing including a coaxial connector fixed to said housing and having a plurality of terminals integrally connected therewith, and a plurality of contacts for said multiple connector press-fitted into said housing; said contacts each including a first portion press-fitted into said housing, and a second portion extending from said housing and bent at a predetermined angle with respect to said first portion, said terminals of said coaxial connectors being connected by means of solder to said conductive patterns of said first printed wiring board, respectively; a second printed wiring board having conductive patterns provided thereon; and means for supporting said first and second printed wiring boards in a parallel relationship with each other in such a manner that said plurality of contacts are brought into resilient contact with said conductive patterns of said second printed wiring board, respectively.

The above and other objects, features and advantages of the present invention and the manner of realizing them will become more apparent, and the invention itself will best be understood from a study of the following description and appended claims with reference to the accompanying drawings showing some preferred embodiments of the invention.

DESCRIPTION OF THE PREFERRED EMBODIMENTS

Figure 1:
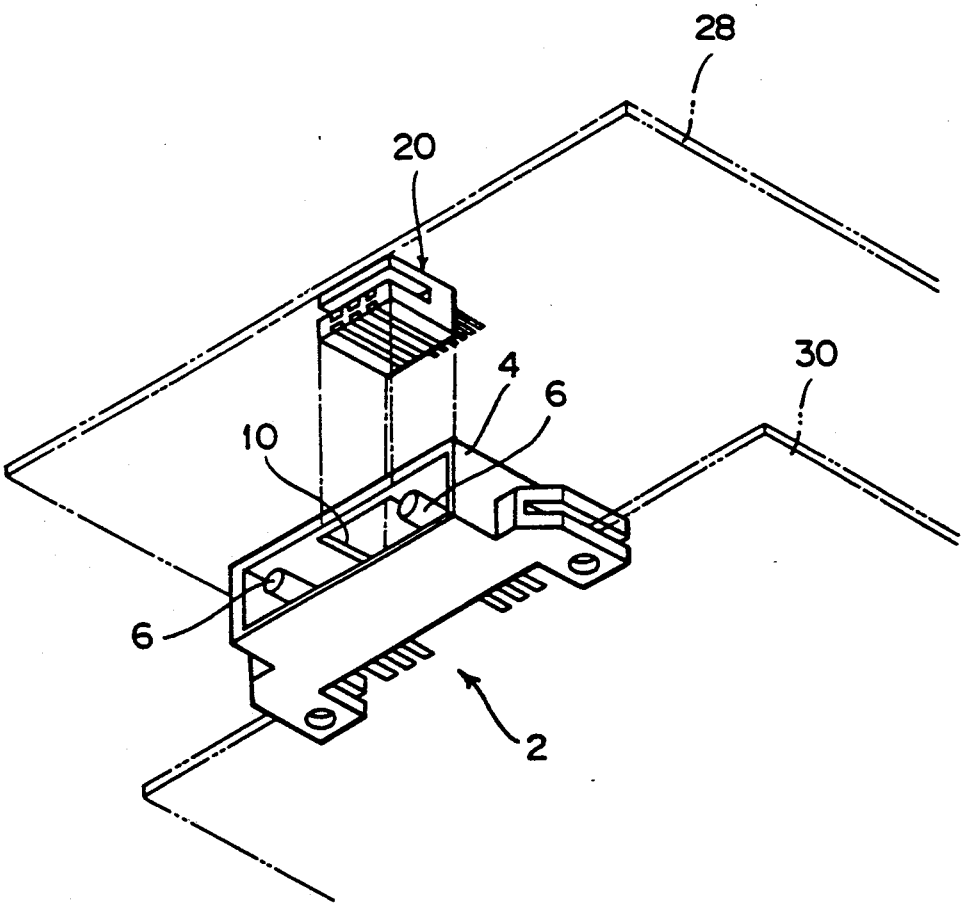
FIG. 1 an exploded perspective view of a connector assembly in accordance with a first embodiment of the present invention.

Referring now to FIG. 1, a printed wiring board 28 includes a low-frequency circuit such as a logic circuit provided thereon, and has at its one end a multiple contact connector 20 fixedly attached to the reverse side thereof. A printed wiring board 30 includes a high-frequency circuit such as a transmit-receive circuit provided thereon, and has at its one end a coaxial connector unit generally designated at 2 which is securely fastened thereto by means of a clamping means described later. The coaxial connector unit 2 comprises a pair of coaxial connectors 6 accommodated in a housing 4 including an opening 10 formed therein and having a predetermined configuration.

For the assembly of a composite connector serving as not only the coaxial connector but also the multiple connector, the housing 4 of the coaxial connector unit 2 fixed to the printed wiring board 30 is abutted against the printed wiring board 28, and then a spacer member is interposed between the other ends of the printed wiring boards 28 and 30 to hold them in a parallel relationship with each other, whereby the multiple connector 20 is received within the housing through the opening 10 provided in the housing 4 of the coaxial connector unit 2.

The construction of the coaxial connector unit 2 will be hereinafter explained in detail with reference to FIGS. 2A through 2C. The coaxial connector unit 2 comprises a pair of coaxial connectors 6 embraced by the housing 4. The coaxial connectors 6 each include a central conductor and an outer conductor as is well known, and have a plurality of terminals 8 for connecting the associated coaxial connectors 6 with the corresponding conductive patterns of the printed wiring board 30 by means of solder, the terminals 8 extending rearwardly from the housing 4 as shown in FIG. 2C. Each of the coaxial connectors 6 has four terminals 8, of which two intermediate terminals are connected to the central conductor, with two outermost terminals thereof being connected to the outer conductor.

Figure 2A:
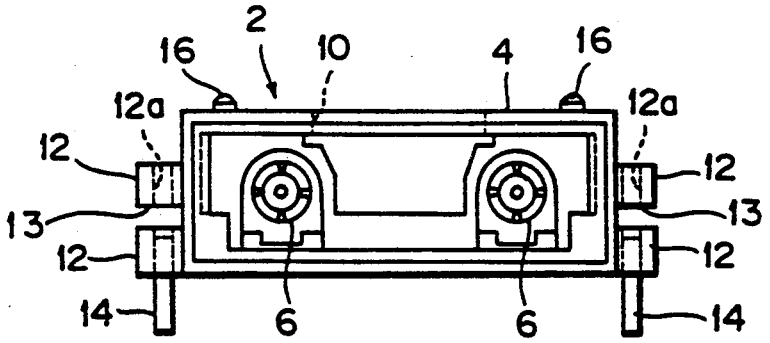
FIG. 2A is a front elevational view of a coaxial connector constituting the connector assembly of the first embodiment of the present invention.
Figure 2B:
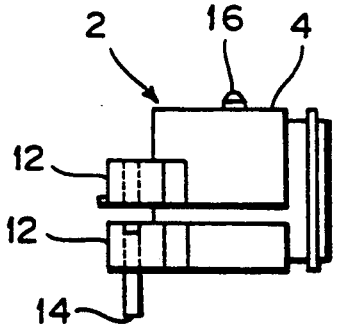
FIG. 2B is a side elevational view thereof.
Figure 2C:
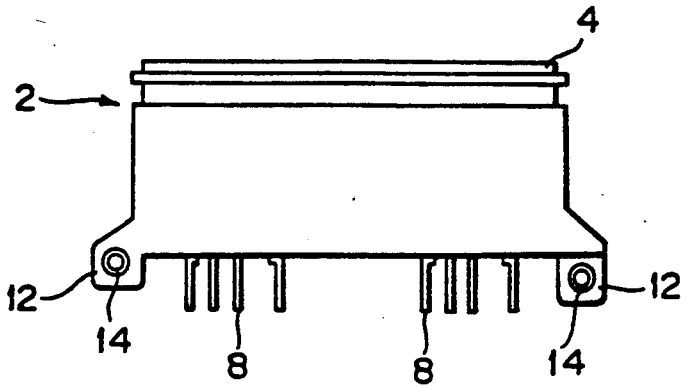
FIG. 2C is a bottom plane view thereof.

As is clear from FIG. 2A, the housing 4 includes a top wall provided with a couple of protrusions 16 for positioning as well as the opening 10 through which the multiple connector 20 is introduced into the housing 4 at the predetermined position. The housing 4 further includes side walls each having a flange integrally formed therewith and adapted to mount the coaxial connector unit 2 on the one end of the printed wiring board 30. In each of the pair of flanges there is provided a small hole 12*a* and a groove 13 for receiving the printed wiring board 30. The printed wiring board 30 is fitted into the grooves 13 correspondingly formed in the flanges 12, and then split sleeves 14 are inserted through the respective small holes 12*a* of the flanges 12, to thereby fix the coaxial connector unit 2 to the printed wiring board 30.

Figure 3A:
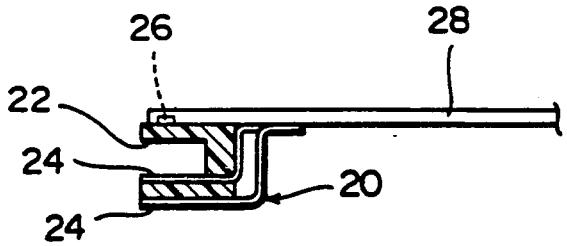
FIGS. 3A to 3C are drawings each illustrating a method of assembling the connector assembly in accordance with the first embodiment.
Figure 3B:
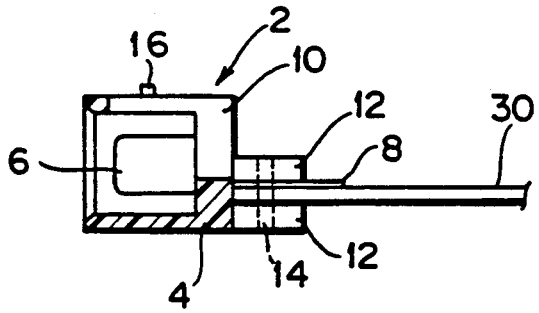
Figure 3C:
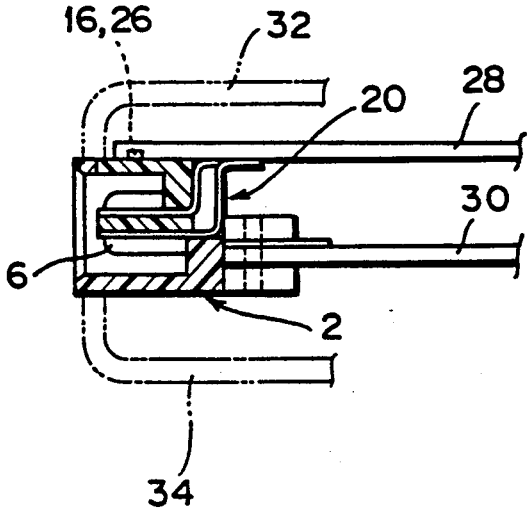

Referring next to FIGS. 3A to 3C, description will be made of a method of assembling a connector assembly in accordance with a first embodiment of the present invention. As illustrated in FIG. 3A, the multiple connector 20 is first secured to the printed wiring board 28. The multiple connector 20 comprises a body 22 having a substantially U-shaped section, and a plurality of contacts 24 mounted on the body 22. The body 22 has at its top surface a pair of protrusions 26 which are designed to mate with holes correspondingly formed on the printed wiring board 28. With the protrusions 26 fitted into the associated holes, the multiple connector 20 is fixedly secured to the underside of the printed wiring board 28 by means of, for example, a double coated tape (or a pressure sensitive tape whose both surfaces are coated with adhesive). Furthermore, one end of each of the contacts 24 is soldered with the conductive pattern not shown formed on the underside of the printed wiring board 28.

As shown in FIG. 3B, the coaxial connector unit 2 is positioned and fixed onto the one end of the printed wiring board 30 by fitting the latter into the grooves 13 of the flanges 12 and forcing the split sleeves 14 into the small holes 12*a* of the flanges 12. The terminals 8 are connected by means of solder with the conductive patterns provided on the printed wiring board 30.

Referring now to FIG. 3, schematically shown is the connector assembly in accordance with the embodiment of the present invention which is incorporated within a casing of a portable telephone set. For the assembly of the portable telephone set, the printed wiring board 28 fitted with the multiple connector 20 is mounted on a front casing 32 while the printed wiring board 30 provided with the coaxial connector unit 2 is mounted on a rear casing 34, and finally the front casing 32 and rear casing 34 are put together in one piece. By virtue of this assembling operation, the multiple connector 20 is allowed to be engaged with the opening 10 of the coaxial connector unit 2 for the completion of the connector assembly in accordance with this embodiment.

According to this embodiment, the multiple connector 20 and the coaxial connector unit 2 are previously fixed on their respective printed wiring boards, thus ensuring an easy construction as compared with the integrally formed coaxial multiple composite connector in the prior art. As a result, cleaning of the surfaces of the printed wiring boards and the connectors which may be required after the mounting of electronic components thereonto is advantageously facilitated.

In addition, the conventional integrally provided coaxial multiple composite connector usually necessitates electrical connections of the coaxial connector and the multiple connector with respect to one of the printed wiring boards, which adversely leads to a further provision of a connector for linking the two printed wiring boards with each other.

While on the contrary, the multiple connector 20 and the coaxial connector unit 2 are independently connected to their respective printed wiring boards in this embodiment, and hence the electrical connection between the two printed wiring boards can be eliminated through an appropriate arrangement of circuit components. Also, by virtue of the construction in which the multiple connector and the coaxial connector are sandwiched by the two printed wiring boards as described above, this connector assembly is effective in the reduction of the device in size.

Inconveniently, this kind of coaxial multiple composite connector inevitably needs an accurate positioning of both the coaxial connector and the multiple connector relative to the connector housing. In this embodiment, the positioning operation of the coaxial connector and the multiple connector can be easily performed through the provision of the protrusions 26 on the multiple connector 20 for positioning of the latter relative to the printed wiring board 28, and through the provision of the pair of protrusions 16 on the coaxial connector unit 2 for positioning of the latter relative to the printed wiring board 28 at the time of assembly. In the printed wiring board 28 there are formed recesses adapted to receive the protrusions 16 and 26 at positions corresponding to these protrusions. The fitting of the protrusions 16 and 26 into the recesses formed in the printed wiring board 28 ensures a coaxial multiple composite connector having a higher dimensional accuracy.

Figure 4:
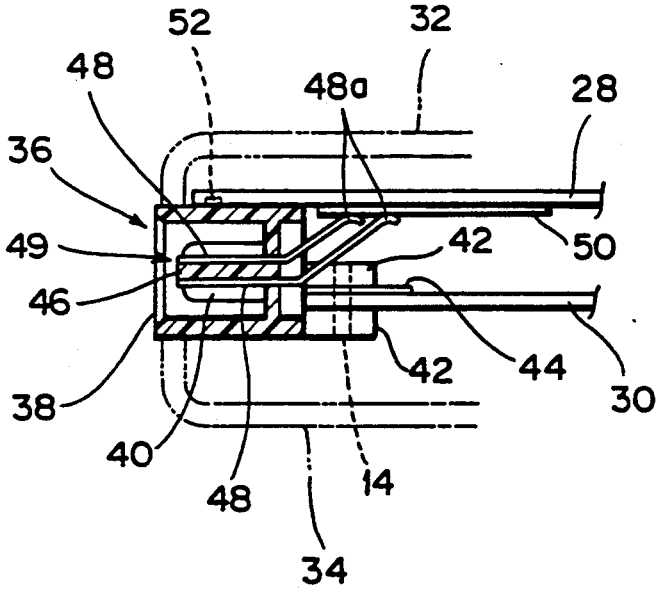
FIG. 4 is a sectional view of a connector assembly in accordance with a second embodiment of the present invention.

The structure of a second embodiment of the present invention will be hereinbelow detailed with reference to FIG. 4. In the drawing, substantially the same elements as those in the first embodiment are designated by the identical reference numerals.

In this embodiment, a coaxial multiple composite connector 36 including a connector housing 38 for accommodating a coaxial connector 40 and a multiple connector 49, is fixedly attached to the lower printed wiring board 30. The fastening of the connector housing 38 onto the printed wiring board 30 is effected by means of flanges 42 and the split sleeves 14, each having the same configuration as in the preceding embodiment. Terminals 44 of the coaxial connector 40 are soldered to corresponding conductive patterns formed on the printed wiring board 30.

Within the inside of the connector housing 38, there is integrally provided a plate-like protrusion 46. The multiple connector 49 includes a plurality of contacts 48 arranged over both surfaces of the plate-like protrusion 46. The contacts 48 are each bent in substantially the middle of the length thereof, and each have a tip 48*a* curved with a small curvature radius. The printed wiring board 28 is mounted on a front casing 32 in place while the printed wiring board 30 fitted with the composite connector 36 is mounted on a rear casing 34 in position, and then they are put together as a unit as shown in FIG. 4. Thus, the tips 48*a* of the contacts 48 are resiliently brought into contact with conductive patterns 50 provided on the underside of the printed wiring board 28.

The positional relationship between the tips 48*a* of the contacts 48 and the conductive patterns 50 can be restricted by fitting projections 52 provided on the top surface of the connector housing 38 into recesses provided correspondingly in the underside of the printed wiring board 28.

Figure 5:
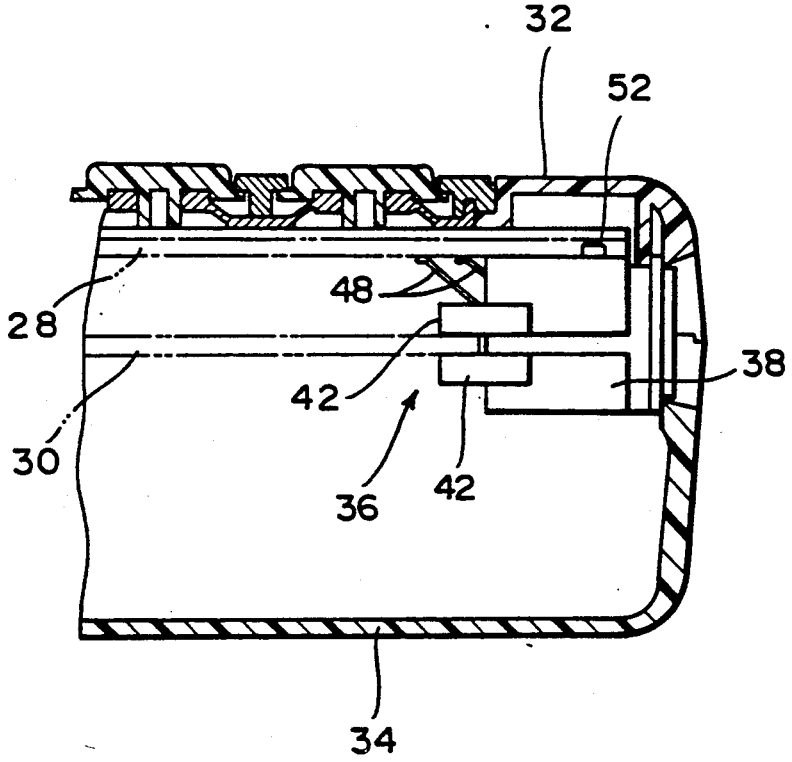
FIG. 5 is a partly cut-away sectional view of a portable telephone set provided with the connector assembly of the second embodiment.

Referring finally to FIG. 5, there is diagrammatically shown a partly cut-away sectional view of a portable telephone set employing the coaxial multiple composite connector of the second embodiment. At the assembly of this portable telephone set, the printed wiring board 30 on which the composite connector 36 is mounted is screwed onto the rear casing 34. The printed wiring board 28 to be subjected to a resilient contact with the contacts 48 is secured to the front casing 32, and then putting the casings 32 and 34 together as one unit in such a manner that the projections 52 provided on the connector housing 38 are fittingly engaged with the holes of the printed wiring board 28.

According to this embodiment, the electrical connection between the printed wiring board 28 and the contacts of the multiple connector can be executed by way of a resilient contact therebetween, which contributes to a simplicity in construction as well as an easy assembly. Also, the integral formation of the coaxial connector and the multiple connector ensures a satisfactory manipulability. Furthermore, as in the preceding embodiment, the electrical connection between the printed wiring boards 28 and 30 can be eliminated through an appropriate circuit arrangement thereof.

What is claimed is:

1. A connector assembly having both functions of a coaxial connector and a multiple contact connector, comprising:

a first printed wiring board having conductive patterns provided thereon;

a coaxial connector secured to one end of said first printed wiring board, said coaxial connector including a housing having an opening with a predetermined configuration, and a plurality of terminals connected by means of solder to said conductive patterns of said first printed wiring board;

a second printed wiring board having conductive patterns provided thereon;

a multiple contact connector having a plurality of contacts fixed to one end of said second printed wiring board and having a configuration to be received through said opening of said coaxial connector, said plurality of contacts of said multiple contact connector being connected by means of solder to said conductive patterns of said second printed wiring board; and means for supporting said first printed wiring board and said second printed wiring board in a parallel relationship with each other in such a manner that said multiple contact connector is positioned within said housing through said opening of said housing of said coaxial connector.

2. A connector assembly according to claim 1, wherein said first printed wiring board includes a transmit and receive circuit provided thereon while said second printed wiring board includes a logic circuit provided thereon.

3. A connector assembly according to claim 1, wherein said coaxial connector housing includes an outer surface having at least two projections provided thereon which correspond to recesses provided in said second printed wiring board, said projections being fitted into said recesses, thereby restricting a positional relationship between said coaxial connector and said multiple contact connector.

4. A connector assembly according to claim 1, wherein said means for supporting said first and second printed wiring boards in a parallel relationship with each other includes said housing of said coaxial connector, and a spacer member interposed between the other ends of said first and second printed wiring boards.

* * * * *